US005269950A

United States Patent [19]

Iwamoto et al.

[11] Patent Number: 5,269,950

[45] Date of Patent: Dec. 14, 1993

[54] TEXTILE TREATING COMPOSITIONS

[75] Inventors: Kunio Iwamoto, Uji; Makoto Inui, Ohtsu; Masaki Iwafuji, Takatsuki; Kazuya Ohtani; Ryoichi Fukui, both of Kyoto, all of Japan

[73] Assignee: Sanyo Chemical Industries, Ltd., Kyoto, Japan

[21] Appl. No.: 790,072

[22] Filed: Nov. 12, 1991

Related U.S. Application Data

[63] Continuation of Ser. No. 533,414, Jun. 5, 1990, abandoned.

[51] Int. Cl.[5] ..... D06M 15/687

[52] U.S. Cl. ..... 252/8.6; 252/8.7; 252/8.75; 252/8.8; 252/8.9

[58] Field of Search ..... 252/8.6, 8.7, 8.75, 252/8.8, 8.9

[56] References Cited

U.S. PATENT DOCUMENTS

| | | | |
|---|---|---|---|
| 3,644,246 | 2/1972 | Lozanou | 252/407 |
| 3,709,656 | 1/1973 | Kusuhara | 8/602 |
| 4,098,701 | 7/1978 | Burrill et al. | 252/8.6 |
| 4,219,605 | 8/1980 | Rohringer | 252/8.1 |
| 4,291,093 | 9/1981 | Wishman et al. | 252/405 |
| 4,397,985 | 8/1983 | Marshall et al. | 524/837 |
| 4,521,320 | 6/1985 | Spivak et al. | 252/402 |
| 4,536,308 | 8/1985 | Pehler et al. . | |
| 4,559,056 | 12/1985 | Leigh et al. | 8/115.64 |
| 4,767,646 | 8/1988 | Cordova et al. | 252/8.6 |
| 5,002,702 | 3/1991 | Wolf et al. | 252/609 |

FOREIGN PATENT DOCUMENTS

| | | | |
|---|---|---|---|
| 16907 | 10/1980 | European Pat. Off. | 252/8.6 |
| 2613 | 3/1963 | Japan . | |
| 1800 | 1/1967 | Japan . | |
| 28235 | 8/1971 | Japan . | |
| 16278 | 5/1972 | Japan . | |
| 31960 | 10/1973 | Japan . | |
| 30060 | 9/1975 | Japan . | |
| 54-15092 | 2/1979 | Japan . | |
| 93878 | 7/1980 | Japan . | |
| 59-16982 | 1/1984 | Japan . | |
| 10071 | 6/1984 | Japan . | |
| 0512904 | 9/1939 | United Kingdom . | |

*Primary Examiner*—Olik Chaudhuri
*Assistant Examiner*—C. Everhart
*Attorney, Agent, or Firm*—Oblon, Spivak, McClelland, Maier & Neustadt

[57] ABSTRACT

Textile treating compositions, comprising at least one metal- or silicon-containing organic compound selected from the group consisting of: 1) an organic titanate containing a phosphorus, sulphur or nitrogen atom, 2) a phosphorodithioate metal salt, 3) a dithiocarbamate metal salt, 4) an aluminum alcoholate, an aluminium ester or an aluminum chelate, 5) a tin-containing carboxylate salt or carboxylate ester and 6) a mercapto group-containing silane compound, are effective for preventing yarn breaking and for improving operation efficiency even at severe conditions and are praticularly useful for treating tire cord.

17 Claims, 1 Drawing Sheet

TEXTILE TREATING COMPOSITIONS

This application is a continuation of application Ser. No. 07/533,414, filed on Jun. 5, 1990, now abandoned.

BACKGROUND OF THE INVENTION

1. Field of the Invention

This invention relates to textile treating compositions.

2. Description of the Prior Art

There have been heretofore used textile treating compositions (hereinafter referred to as treating compositions) for reducing friction between yarn and metal, comprising lubricants (such as mineral oils, animal and vegetable oils, fatty esters, alkyl ether esters and waxes), surfactants and anti-static agents.

Accompanied with high-speed operations in textile treating (such as spinning, stretching, fine spinning and the like), there have been demanded treating compositions capable of preventing breaking of yarn and improving operating efficiency even at severe treating conditions.

SUMMARY OF THE INVENTION

It is an object of the present invention to provide a treating composition capable of preventing breaking of yarn and improving operating efficiency even at severe treating conditions.

It is another object of the present invention to provide a treating composition endurable friction between yarn and metal in high-speed treating operations, without breaking oil membrane of the composition adhered to the textile.

It is still another object of the present invention to provide a treating composition applicable to tire cord yarn at severe conditions of friction between the yarn with heated rollers under high pressure contact states.

Briefly, these and other objects of the present invention as hereinafter will become more readily apparent have been attained broadly by a treating composition, which comprises (A) at least one metal- or silicon-containing organic compound selected from the group consisting of:

1) an organic titanate containing a phosphorus atom, sulphur atom or nitrogen atom,
2) a phosphorodithioate metal salt,
3) a dithiocarbamate metal salt,
4) an aluminium alcoholate, an aluminium ester or an aluminum chelate,
5) a tin-containing carboxylate salt or carboxylate ester, and
6) a mercapto group-containing silane compound.

BRIEF DESCRIPTION OF THE DRAWINGS

In FIG. 1, 1 and 6 represent fixed ends; 2, 3, 4 and 5 represent movable pulleys; 7 represents oiled yarn; 8 represents a heated metal friction-roter; and 9 represents a weight.

DETAILED DESCRIPTION OF THE PREFERRED EMBODIMENTS

Figure 1:
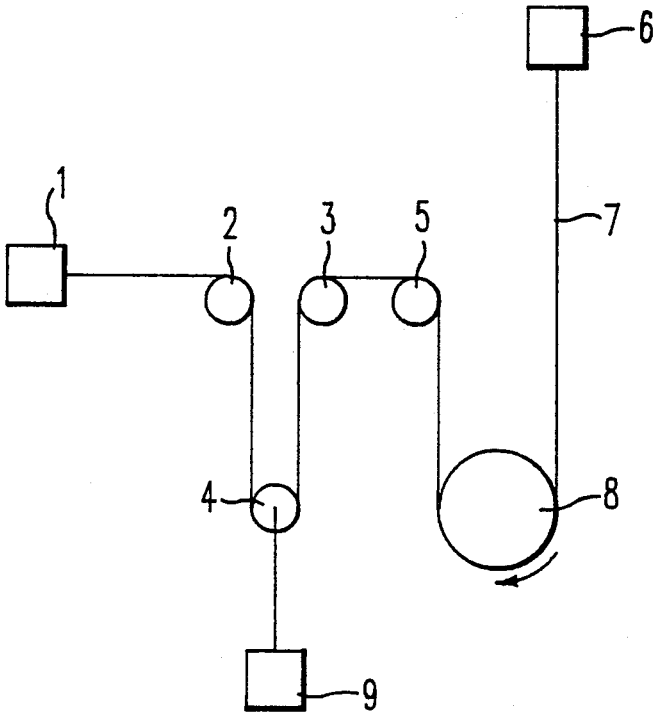
FIG. 1 is an illustration of an equipment for measuring the resistance to yarn breaking.

Suitable organic titanate, containing a phosphorus atom, sulphur atom or nitrogen atom, include organic titanates represented by the formula (1a):

$$(R_1O)_m—Ti—(A_1)_n \quad (1a);$$

and complexes of an organic titanate with a phosphite, represented by the formula (1b):

$$(R_1O)_4—Ti[P—(OX_1)_3]_2 \quad (1b)$$

wherein $A_1$ is a residue of acid or ester, which may contain a phosphorus atom, sulphur atom or nitrogen atom, at least a part of $A_1$ being a residue of acid or ester containing a phosphorus atom, sulphur atom or nitrogen atom; $R_1$ is alkyl, alkenyl or aryl group, which may contain an ether oxygen and/or amino group, or $R_1$ may be joined with another $R_1$ or $A_1$ to form a divalent group; m and n are 0 and/or integers of 1 or more, satisfying $m+n=4$; and $X_1$ is H and/or an alkyl group.

In the formulae (1a) and (1b), examples of alkyl or alkenyl groups of $R_1$, which may contain an ether oxygen and/or amino group, are alkyl groups containing 1–20 carbon atoms or more, such as methyl, ethyl, n- and iso-propyl, n- and iso-butyl, n- and iso-amyl, 2-ethylhexyl, octyl, lauryl, palmityl, oleyl, stearyl and iso-stearyl groups; ether oxygen-containing alkyl or alkenyl groups, such as 2,2-diallyloxymethyl-1-butyl group; and amino group-containing alkyl or alkenyl groups, for example, $NH_2(Y_1—NH)_kY_1—$, wherein $Y_1$ is an alkylene group containing 2–6 carbon atoms and k is an integer of 0–6, such as N-aminoethylaminoethyl group; and exemplery of aryl groups $R_1$ are phenyl, and alkylaryl groups having $C_1$–$C_{12}$alkyl, for example, alkylphenyl groups, such as crezyl, tolyl, cumylphenyl, octylphenyl and nonylphenyl groups. Examples of acids and ester constituting said residue $A_1$ include fatty acids, such as caprylic, stearic, acrylic and methacrylic acids; phosphoric acids and esters thereof, such as compounds containing an alkyl pyrophosphate group of the formula (1c) or an alkyl phosphate group of the formula (1d):

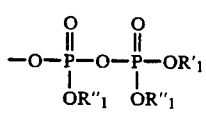

(1c)

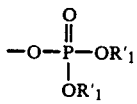

(1d)

wherein $R'_1$ is an alkyl group containing 1–20 carbon atoms, $R''_1$ is H or an alkyl group containing 1–20 carbon atoms, for example, dialkyl pyrophosphates (such as dioctyl pyrophosphate and ditridecyl pyrophosphate), and dialkyl phosphates (such as dioctyl phosphates); and sulfonic acids, for instance, alkylbenzene sulfonic acids (such as dodecylbenzene sulfonic acid). Plural $R_1$'s, $Y_1$', $A_1$'s, $R'_1$'s or $R''_1$'s may be the same or different. It is essential that at least one of $R_1$ and $A_1$ contains at least one phosphorus atom, sulphur atom or nitrogen atom; for titanates free from phosphorus, sulphur or nitrogen atom result in poor resistance to breaking of yarn. Among combinations of m and n, preferred are $m=1$ and $n=3$, and $m=4$ and $n=0$. Examplery of alkyl groups of $X_1$ are those containing 1–20 carbon atoms or more, such as octyl and tridecyl groups. Among three $X_1$'s, preferred is one is H and the other two are alkyl groups.

Illustrative examples of said organic titanates include titanates of the formula (1a), such as iso-propyl tris(dioctylpyrophosphate) titanate, iso-propyl tris(N-aminoethyl-aminoethy) titanate, bis(dioctylpyrophosphate) oxyacetate titanate, bis(dioctylpyrophosphate) ethylene titanate, iso-propyl tridecylbenezenesulfonyl titanate, and iso-propyl-tris(dioctylphosphate) titanate; and complexes of the formula (1b), such as tetraoctyl-bis(ditridecyl-phosphite) titanate, tetra(2,2-diallyloxymethyl-1-butyl-bis(ditridecyl-phosphite) titanate, and tetra-iso-propyl-bis(dioctyl-phosphite) titanate. Among these, preferred are iso-propyl tris(dioctylpyrophosphate) titanate, iso-propyl tris(N-aminoethyl-aminoethyl) titanate, bis(dioctylprophosphate) ethylene titanate and iso-propyl tridecylbenzenesulfonyl titanate; particularly, iso-propyl tris (dioctylpyrophosphate) titanate, iso-propyl tris(N-amino-ethyl-aminoethy) titanate and iso-propyl tridecylbenzenesulfonyl titanate.

Suitable phosphorodithioate metal salts include those of the formula (2):

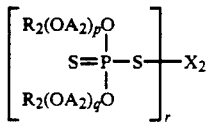

(2)

wherein $R_2$ is an alkyl or aryl group, $A_2$ is an alkylene group containing 2–4 carbon atoms, p and q are 0 and/or integers of 1 or more, r is an integer of 1–4, and $X_2$ is a mono-, di-, tri- or tetra-valent metal.

In the formula (2), alkyl groups $R_2$ include those mentioned above as to R1, preferably those containing 2–20 carbon atoms; and aryl groups $R_2$ are as mentioned above $R_1$. Among these, preferred are n- and iso-butyl, n- and iso-amyl, octyl, lauryl, oleyl and stearyl groups, particularly n-butyl, n-amyl, octyl, lauryl and oleyl groups. Alkylene groups $A_2$ are inclusive of ethylene, propylene, and 1,2-, 1,3-, 1,4- and 2,3-butylene groups. Among these, preferred are ethylene and combinations thereof with propylene, especially ethylene group. Plural $R_2$'s and/or $A_2$'s may be the same or different. Illustrative of said metal $X_2$ are monovalent metals, such as Na, K, Li and the like; divalent metals, such as Zn, Pb, Cu, Cd, Ba, Ca, Mg, Mn, Co, Ni and the like; trivalent metals, such as Sb, Al and the like; and tetravalent metals, such as Sn, Ti and the like. Among these preferred are Na, Zn, Pb, Cd, Sb, Sn and Ti, particularly Zn, Pb, Cd and Sb. The integers p and q are preferably 1 or more; and the total of p+q is preferably 2–40, more preferably 2–10. When p+q is more than 40, the effects preventing yarn breaking and improving operation efficiency become insufficient.

Illustrative examples of phosphorodithioate metal salts include zinc di(di-n-butylphosphorodithioate), zinc di(di-n-amylphosphorodithioate), lead di(di-n-amylphosphorodithioate), cadmium di(di-n-amylphosphorodithioate), antimoney tri(di-n-butylphosphorodithioate), antimoney tri(dilaurylphosphorodithioate), antimoney tri(dioctylphenylphosphorodithioate), and the like; as well as oxyalkylated ones, such as zinc di[di-n-butyl(EO)2 phosphorodithioate], antimoney tri[dilauryl(EO)3 phosphorodithioate], and so on.

Suitable dithiocarbamate salts include those represented by the formula (2):

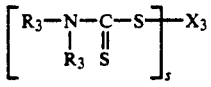

(3)

wherein $R_3$ is an alkyl or aryl group, s is an integer of 1–4, and $X_3$ is a mono-, di-, tri- or tetra-valent metal or compounds thereof.

In the formula (3), examples of alkyl and aryl groups $R_3$ and preferable ones thereof may be the same as those mentioned above as $R_2$. Illustrative of said metal $X_3$ are monovalent metals, such as Na, K and the like; divalent metals, such as Zn, Pb, Cu, Cd, Ba, Mo and the like; trivalent metals, such as Sb and the like; and tetravalent metals, such as Sn, Ti and the like. Compounds (atomic groups) of these metals include, for example, $Mo_2S_xO_y$, such as $Mo_2S_2O_2$. Among these preferred are Na, Zn, Pb, Cd, Sb, Sn, Ti and $Mo_2S_2O_2$, particularly Zn, Pb, Cd, Sb and $Mo_2S_2O_2$. Plural $R_3$'s may be the same or different.

Illustrative of dithiocarbamate salts are zinc di-n-butyldithiocarbamate, zinc di-n-amyldithiocarbamate, lead di-n-amyldithiocarbamate, cadmium di-n-amyldithiocarbamate, antimoney di-n-butyldithiocarbamate, antimoney di-n-butyldithiocarbamate, sulfurized oxymolybdenum organo di-n-butyldithiocarbamate, and the like.

Suitable aluminium alcoholates and aluminium esters include those represented by the formula (4):

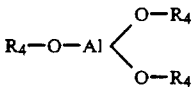

(4)

wherein $R_4$ is an alkyl, alkenyl, aryl or acyl group, which may contain an amino group.

In the formula (4), examples of alkyl, alkenyl and aryl groups $R_4$ include those described above as to $R_1$. Acyl groups include, for example, acetyl and benzoyl groups. Exemplary of alkyl, alkenyl, aryl and acyl groups, containing an amino group, are those mentioned above as to $R_1$ and aminoethyl, aminooleyl, p-aminophenyl and aminoacetyl groups. Plural $R_3$'s may be the same or different.

Illustrative examples of aluminium alcoholates and aluminium esters include mono-sec-butoxyaluminum diisopropylate, aluminum triisostearate, aluminum tri-sec-butylate, tristearyl aluminate, iso-propyldiaminoethyl aluminate, iso-propyldidecylbenzene aluminate, iso-propyldidiisustearoyl aluminate, iso-propyldioctanoyl aluminate, and the like.

Suitable mercapto group-containing silane compounds include those represented by the formula (5a) or (5b):

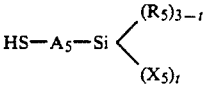

(5a)

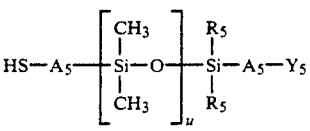

(5b)

wherein $R_5$ is an alkyl group containing 1–20 carbon atoms, $A_5$ is an alkylene group containing 2–4 carbon atoms, $X_5$ is an alkoxy group containing 1–4 carbon atoms, t is an integer of 1–3, $Y_5$ is SH or H, and u is 0 or an integer of 1–10000.

In the formulae (5a) and (5b), alkyl groups $R_5$ include straight-chain or blanched, saturated or unsaturated alkyl groups, for example, those (alkyl and alkenyl) mentioned above as to $R_1$. Among these, preferred are ethyl, n- and iso-propyl, and n- and iso-butyl groups. Examples of alkylene groups $A_5$ include those described above $A_2$. Alkoxy groups $X_5$ include methoxy, ethoxy, n- and iso-propoxy, and n- and iso-butoxy groups. The integer u may vary up to 10000, preferably 7000 or less. When u is higher than 10000, high-load friction becomes too high and effects to prevent yarn breaking are not sufficiently attained. Plural $R_3$'s and/or $A_5$'s may be the same or different.

Illustrative of mercapto group-containing silane compounds are gamma-mercaptopropyltrimethoxysilane, gammamercaptopropylmethyldimethoxysilane; and compounds of the formula (5b), wherein wherein $R_5$ is methyl group, $A_5$ is propylene group and $Y_5$ is SH, for example those having a viscosity (at 25 degrees C.) of 60 cst and of 85 cst.

Suitable tin-containing carboxylate salts or carboxylate esters include those represented by the formula (6a), (6b) or (6c):

$$(X_6)_aSn \quad (6a)$$

$$(Y_6)_{4-b}Sn(OOCR_6)_b \quad (6b)$$

$$(X_6)_cSn—Q_6—Sn(X_6)_c \quad (6c)$$

wherein a and b are integers of 1–4, c is an integer of 1–3; $X_6$ is selected from the group consisting of H, a substituted or unsubstituted hydrocarbon group, hydroxyl group, amino group, alkylamino group, arylamino group, alkoxy group, alkylthio group, arylthio group, mercapto group, acyl group, acyloxy group and halogen atom, at least a part of $X_6$ having ester group; $Y_6$ is selected from the group consisting of H, a substituted or unsubstituted hydrocarbon group, hydroxyl group, amino group, alkylamino group, arylamino group, alkoxy group, alkylthio group, arylthio group, mercapto group, acyl group, acyloxy group and halogen atom; $R_6$ is H, a substituted or unsubstituted hydrocarbon group or $—(A_6)_dCOOR'$; $A_6$ is an alkylene group; d is 0 or 1; R' is H, metal cation, ammonium ion or substituted or unsubstituted hydrocarbon group; $Q_6$ is O, S or $—(A_6)_dCOO—$.

In the formulae (6a), (6b) and (6c), hydrocarbon groups of $X_6$, $Y_6$ and R' include hydrocarbyl groups containing 1–30 or more carbon atoms, such as alkyl, alkenyl, aralkyl, aryl, cycloalkyl and cycloalkenyl groups, which may be substituted one or more substituents. Substituents include, for example, hydroxyl, amino, halogeno, mercapto, alkylthio, nitro, alkoxy, aldehyde and acyl groups. Examples of alkyl, alkenyl and aryl groups include those mentioned above $R_1$, among which preferred are n- and iso-butyl, octyl, lauryl, oleyl and stearyl groups, particularly n-butyl, octyl, lauryl and oleyl groups. Exemplary of aralkyl, aryl, cycloalkyl and cycloalkenyl groups are benzyl, cyclohexy and cyclohexenyl groups. Other groups include those containing $C_1$–$C_{30}$ hydrocarbon groups, for example, alkylamino and arylamino groups, such as mono- and di-methylamino, butylamino, and phenyl amino groups; alkoxy groups, such as methoxy, ethoxy, propoxy, butoxy, ethylhexyloxy, lauryloxy, oleyloxy and stearyloxy groups; alkylthio and arylthio groups, such as methylthio, laurylthio and phenylthio groups; acyl and acyloxy groups, such as acetyl, butyroyl, oleoyl and stearoly groups, and the corresponding acyloxy groups; and halogen atoms, such as F, Cl, Br and I. Among these groups, preferred are hydrocarbon groups, alkoxy groups and alkylthio groups. Examples of $X_6$ having ester group are $—(A_6)_dCOOR''$ and $—(A_6)_dOCOR''$, wherein R'' is a substituted or unsubstituted hydrocarbon group, as mentioned above. The integer a is preferably 2–4, particularly 4.

Examples of tin-containing carboxylate salts and carboxylate esters include those of the formulae (a) to (h) written in Austrian Patent 236,924, wherein at least a part of R and/or X is a COO group-containing radical.

Preferable tin-containing carboxylate salts and carboxylate esters include those represented by the formula (7a), (7b) or (7c):

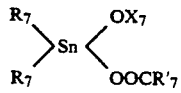
(7a)

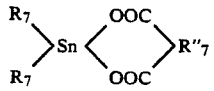
(7b)

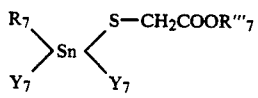
(7a)

wherein $R_7$ is an alkyl or aryl group; $R'_7$ is a residue of monocarboxylic acid; $R''_7$ is a residue of dicarboxylic acid; $R'''_7$ is a residue of monohydric alcohol; $X_7$ is H or $—OCR'_7$; $Y_7$ is an alkyl group or $—S—CH_2COOR'''_7$.

In the formulae (7a), (7b) and (7c), examples of alkyl and aryl groups $R_7$ include those mentioned above $R_1$. Among these, preferred are the same as $R_6$. Monocarboxylic acids $R'_7$—COOH constituting the residue $R'_7$ include those containing 1–30 carbon atoms, for example, fatty acids, such as propionic, capric, lauric, stearic, iso-stearic, behenicmontanic and oleic acids; and sulfur-containing monocarboxylic acid, including alkylthiopropionic acids, such as laurylthiopropionic, palmitylthiopropionic, oleylthiopropionic and stearylthiopropionic acids. Among these, preferred are those containing at least 10 carbon atoms, specifically lauric, palmitic, stearic, iso-stearic, oleic, laurylthiopropionic and palmitylthiopropionic acids; particularly lauric, stearic, oleic and laurylthiopropionic acids. Dicarboxylic acids HOOC—$R''_7$—COOH constituting the $R''_7$ are inclusive of aliphatic ones, such as succinic and maleic acids, and aromatic ones, such as phthalic acid. Among these, preferred are maleic and phthalic acids. Monohydric alcohols $R'''_7$—OH constituting the residue $R'''_7$ include those containing 1–40 carbon atoms, for example, methyl, ethyl, n-and iso-propyl, octyl, decyl, lauryl, palmityl, stearyl, iso-stearyl and oleyl alcohols, and synthetic branched alcohols, such as those having degree of branching of 10–70% and 10–30 carbon atoms; as well as alkylene oxide adducts of these alcohols, for example, adducts of 1–10 moles of one or more alkylene oxides containing 2–4 carbon atoms (such as ethylene oxide and/or propylene oxide). Among these, preferred are preferred are those containing at least 10 carbon atoms, specifically lauryl, palmityl, stearyl, iso-stearyl and oleyl alcohols, and synthetic alcohols (degree of branching: 20–50%; 12–24 carbon atoms); particularly lauryl, palmityl and stearyl alcohols. Alkyl groups of $Y_7$ and preferable ones thereof are the same as $R_7$.

Illustrative examples of the compounds of the formulae (7a), (7b) and (7c) are:

(a) dibutyltinhydroxymonolaurate, dibutyltindilaurate, dioctyltinhydroxymonolaurate, dioctyltindilaurate, dioctyltinhydroxymonooleate, dioctyltindioleate;

(b) dibutyltinmaleate, dibutyltinphthalate, dioctyltinmaleate, dioctyltinphthalate; and (c) $C_4H_9Sn(SCH_2COOC_{12}H_{25})_3$, $(C_4H_9)Sn(SCH_2COOC_{12}H_{25})_2$, $C_8H_{17}Sn(SCH_2COOC_{12}H_{25})_3$, and $(C_8H_{17})_2Sn(SCH_2COOC_{12}H_{25})_2$;

as well as mixtures of two or more of them. Preferred are dibutyltindilaurate, dioctyltindilaurate and particularly dioctyltindioleate, among (a); dibutyltinmaleate and dioctyltinmaleate, among (b); and $(C_8H_{17})_2Sn(SCH_2COOC_{12}H_{25})_2$ among (c).

In general, treating compositions further comprise (B) at least one component selected from the group consisting of a lubricant, a surfactant and an antistatic agent.

Suitable lubricants include, for example, mineral oils, such as purified spindle oil, liquid paraffin and the like; animal and vegetable oils, such as coconut oil, sardine oil, castor oil and the like; sulfur-containing esters, such as dioleyl thiodipropionate, di-iso-stearyl thiodipropyonate; fatty esters, such as 2-ethyl-hexyl stearate, tridecyl stearate, isostearyl laurate, oleyl oleate, dioleyl adipate, trimethylolpropane trioleate, pentaerythritol tetraoleate and the like, alkyl ether esters (esters of polyoxyalkylene alkyl ethers), such as lauryl alcohol (EO)2 (adduct of 2 moles of ethylene oxide to lauryl alcohol; similar expressions are used hereinafter) laurate, tridecyl alcohol(EO)3 laurate, tridecyl alcohol(EO)3 thiodipropionate, and the like; and waxes (such as paraffin waxe, carnauva wax, montan wax, polyolefin wax and the like). [In the above and hereinafter, EO and PO represent ethylene oxide and propylene oxide, respectively.] Among these, preferred are fatty esters, sulfur-containing esters and alkyl ether esters.

Surfactants include nonionic, cationic, anionic and amphoteric ones.

Illustrative of suitable surfactants are nonionic surfactants, for example, oxyalkylated higher alcohols [such as EO and/or PO adducts of stearyl alcohol, octyl alcohol and the like] and oxyalkylated esters of polyhydric alcohol [such as EO adducts of castor oil, hardened castor oil, sorbitan trioleate and the like]; polyhydric alcohol esters, for instance, Span-type surfactants, such as Span 20 and Span 40; amide-containing surfactants, for example, aliphatic alkanol amides, such as lauryl diethanol amide and oleyl diethanol amide, and fatty amides, such as oleyl amide, and the like. Among these, preferred are oxyalkylated higher alcohols [particularly stearyl alcohol(EO and/or PO)5-50 and octyl alcohol (EO and/or PO)5-50] and oxyalkylated esters of polyhydric alcohol [particularly hardened castor oil(EO)25 and sorbitan(EO)20 trioleate].

Antistatic agents include nonionic, cationic, anionic and amphoteric ones, and inorganic salts, and the like.

Suitable antistatic agents include anionic ones, for example, phosphates and phosphites, such as fatty alcohol phosphate salts and oxyethylated fatty alcohol phosphate salts, and the corresponding phosphite salts; carboxylates, such as fatty soaps and metal soaps; sulfonates, such as aliphatic sulfonic acid salts; and sulfates, such as fatty alcohol sulfate salts and oxyethylated fatty alcohol sulfate salts; cationic ones, such as higher alkyl ammonium salts; amphoteric ones, such as alkylbetaines; and nonionic ones. Among these, preferred are phosphates and carboxylates (metal salts of fatty acids).

Treating compositions may contain optionally one or more other additives and pH adjuster. Exemplery of such additives are anti-oxidants, UV absorbers, silicone compounds, fluorine-containing compounds, and the like. As pH adjuster, there may be used alkali, oxyalkylated alkyl amine or the like.

In the present invention, the content of said compound (A) is not particularly restricted and can vary widely in such an amount of usually 0.2%–100%, preferably 0.5%–70%, based on the weight of the composition. Use of said compound (A) in lower amount than 0.2% results in insufficient effects to prevent breaking of yarn and to improve operating efficiency at severe treating conditions. In case of aluminium alcoholates, aluminium esters or aluminum chelates, the content is preferably 0.2–50%, more preferably 0.3–20%. The content of lubricant is usually 0–90%, preferably 10–90%, more preferably 15–80%; that of surfactant is generally 0–70%, preferably 10–70%, more preferably 15–60%; that of anti-static agent is usually 0–20%, preferably 1–20%, more preferably 1–15%; that of other additive is generally 0–10%, preferably 0.2–10%, more preferably 0.3–8%; that of pH adjustor is usually 0–10%, preferably 0.02–10%, more preferably 0.03–8%.

Compositions of this invention can be applyed to textile materials. Suitable textile materials include, for example, natural fibers (such as cotton, wool, silk and the like); regenerated fibers (such as rayon, acetate, bemberg and the like), and synthetic fibers (such as polyester, polyamide, polyacyclic, polyethylene, polypropylene, polyvinylic and alamide fibers, and the like). These textile materials may be in the form of short fiber, long fiber, monofilament, multifilament, yarn or fabric. Compositions of the invention are particularly useful for treating tire cord yarn.

The amount of the composition of this invention applied onto the textile materials may be varied according to the kinds, forms, sizes of the textile materials and so on, but it is used in such an amount of generally 0.1–5%, preferably 0.2–3% to the weight of the textile materials.

Compositions of this invention may be applied by any known methods, for instance, as non-aqueous forms (straight oil, or diluted with low viscosity mineral oil), or as aqueous emulsions, using various oiling means, such as roller oiling, nozzle oiling, spray oiling and dipping, at any stage during fiber-forming process and finishing process. In using compositions of the invention in tire cord producing process, the compositions may be applied either just after spinning or after drawing.

Having generally described the invention, a more complete understanding can be obtained by reference to certain specific examples, which are included for purposes of illustration only and not intended to be limiting unless otherwise specified.

In the following examples, parts, ratio and % mean parts by weight, weight ratio and % by weight, respectively.

Materials used in these examples are as follows:

Surfactant-1: Hardened castor oil(EO)25
Surfactant-2: Octyl alcohol PO-EO block adduct
Surfactant-3: Sorbitan trioleate(EO)20
Titanate-1: Isopropyl-tris(dioctylpyrophosphate) titanate
Titanate-2: Isopropyl-tris(N-aminoethylaminoethyl) titanate
Titanate-3: Isopropyl-tridecylbenzene sulfonil titanate
Titanate-4: Isopropyl-tri-stearoyl titanate
Phosphorothioate-1: Zn di(di-n-butylphosphorodithioate)
Phosphorothioate-2: Zn di(di-n-amylphosphorodithioate)
Phosphorothioate-3: Sb tri(di-n-butylphosphorodithioate)
Phosphorothioate-4: Sb tri[dilauryl(EO)3phosphorodithioate
Thiocarbamate-1: zinc di-n-butyldithiocarbamate
Thiocarbamate-2: zinc di-n-amyldithiocarbamate
Thiocarbamate-3: antimoney di-n-butyldithiocarbamate
Thiocarbamate-3: sulfurized oxymolybdenum organo di-n-butyldithiocarbamate
Al compound-1: mono-sec-butoxyaluminum diisopropylate
Al compound-2: aluminum triisostearate
Al compound-3: iso-propyldioctanoyl aluminate
Al compound-4: iso-propyldiaminoethyl aluminate
Mercaptosilane-1: gamma-mercaptopropyltrimethoxysilane
Mercaptosilane-2: gamma-mercaptopropylmethyldimethoxysilane
Mercaptosilane-3: polydimethylsiloxane having terminal mercaptopropyl groups in both ends (Viscosity: 60 cst at 25 degrees C.)
Silicone-1: polydiorganosiloxane (60 cst at 25 degrees C.)
Silicone-2: polyoxyalkylene-modified silicone (120 cst at 25 degrees C.)

EXAMPLE 1-5 AND COMPARATIVE EXAMPLES 1-4

According to the formulations (%) shown in Table 1, treating compositions of this invention and those for comparison were prepared.

Each composition was applied onto a Nylon tire cord yarn (hot water-washed yarn of 6-Nylon tirecord of 1260De/204f) in an amount of 1.0% by weight. As shown in FIG. 1, this oiled yarn (7) was contacted at a high contact pressure with a heated metal friction-roter (8) under the following conditions, and there was measured the elasped time (minutes) until breaking of yarn was ocurred to evaluate resistance to yarn breaking. The results were as shown in Table 1.

Load: 3 kg;
Roater: a rotating textured chromium frictional body;
Roatary speed: 80 m/minute;
Frictional body temperature: 180 degrees C.

TABLE 1

| | Example No. | | | | | | | | |
|---|---|---|---|---|---|---|---|---|---|
| | Example | | | | | Comparative Example | | | |
| | 1 | 2 | 3 | 4 | 5 | 1 | 2 | 3 | 4 |
| Dioleyl adipate | 59 | 57 | 50 | 50 | 50 | 60 | 55 | 50 | 50 |
| Surfactant-1 | 30 | 30 | 30 | 30 | 30 | 30 | 30 | 30 | 30 |
| Surfactant-2 | 10 | 10 | 10 | 10 | 10 | 10 | 10 | 10 | 10 |
| Surfactant-3 | — | — | — | — | — | — | 5 | — | — |
| Titanate-1 | 1 | 3 | 10 | — | — | — | — | — | — |
| Titanate-2 | — | — | — | 10 | — | — | — | — | — |

TABLE 1-continued

| | Example No. | | | | | | | | |
|---|---|---|---|---|---|---|---|---|---|
| | Example | | | | | Comparative Example | | | |
| | 1 | 2 | 3 | 4 | 5 | 1 | 2 | 3 | 4 |
| Titanate-3 | — | — | — | — | 10 | — | — | — | — |
| Titanate-4 | — | — | — | — | — | — | — | — | 10 |
| Tetra-n-butyl titanate | — | — | — | — | — | — | — | 10 | — |
| Resistance to yarn breaking | 27 | 26 | 24 | 25 | 25 | 14 | 13 | 16 | 18 |

EXAMPLES 6-10 AND COMPARATIVE EXAMPLES 5-6

According to the formulations (%) shown in Table 2, treating compositions of this invention and those for comparison were prepared.

Each composition was applied onto a polyester tire cord yarn (hot water-washed yarn of of 1500De/288fil) in an amount of 1.0% by weight. This oiled yarn was run, contacted with a heated metal frictional body under a high contact pressure, and the friction (high-load friction $T_2$, g) was measured using a high-load friction meter under the following conditions. The results were as shown in Table 2.

Initial tention: $T_1=3{,}000$ g;
Frictional body: a textured chromium rod;
Frictional body temperature: 200 degrees C.

TABLE 2

| | Example No. | | | | | | |
|---|---|---|---|---|---|---|---|
| | Example | | | | | Comparative Example | |
| | 6 | 7 | 8 | 9 | 10 | 5 | 6 |
| Dioleyl adipate | 55 | 50 | 50 | 50 | 50 | 50 | 50 |
| Surfactant-1 | 30 | 30 | 30 | 30 | 30 | 30 | 30 |
| Surfactant-2 | 10 | 10 | 10 | 10 | 10 | 10 | 10 |
| Phosphorothioate-1 | 5 | 10 | — | — | — | — | — |
| Phosphorothioate-2 | — | — | 10 | — | — | — | — |
| Phosphorothioate-3 | — | — | — | 10 | — | — | — |
| Phosphorothioate-4 | — | — | — | — | 10 | — | — |
| Di-2-ethylhexyl dithiophosphate oleylamine salt | — | — | — | — | — | 10 | — |
| Sulfurized oxymolybdenum di 2-ethylhexyl-dithiophosphate | — | — | — | — | — | — | 10 |
| Friction ($T_2$, g) | | | | | | | |
| 0.5 m/min.* | 3220 | 3100 | 3120 | 3150 | 3270 | 3380 | 3520 |
| 300 m/min.* | 4130 | 4080 | 4120 | 4140 | 4160 | 4280 | 4320 |

*Yarn speed

EXAMPLES 11-15 AND COMPARATIVE EXAMPLES 7-8

According to the formulations (%) shown in Table 3, treating compositions of this invention and those for comparison were prepared.

In the same manner as Examples 6-10, each composition was applied onto a polyester tire cord yarn the friction was measured. The results were as shown in Table 3.

TABLE 3

| | Example No. | | | | | | |
|---|---|---|---|---|---|---|---|
| | Example | | | | | Comparative Example | |
| | 11 | 12 | 13 | 14 | 15 | 7 | 8 |
| Dioleyl adipate | 55 | 50 | 50 | 50 | 50 | 60 | 55 |
| Surfactant-1 | 30 | 30 | 30 | 30 | 30 | 30 | 30 |
| Surfactant-2 | 10 | 10 | 10 | 10 | 10 | 10 | 10 |

TABLE 3-continued

| | Example No. | | | | | | |
|---|---|---|---|---|---|---|---|
| | Example | | | | | Comparative Example | |
| | 11 | 12 | 13 | 14 | 15 | 7 | 8 |
| Surfactant-3 | — | — | — | — | — | — | 5 |
| Thiocarbamate-1 | 5 | 10 | — | — | — | — | — |
| Thiocarbamate-2 | — | — | 10 | — | — | — | — |
| Thiocarbamate-3 | — | — | — | 10 | — | — | — |
| Thiocarbamate-4 | — | — | — | — | 10 | — | — |
| Friction ($T_2$, g) | | | | | | | |
| 0.5 m/min.* | 3210 | 3140 | 3150 | 3090 | 3280 | 3460 | 3510 |
| 300 m/min.* | 4150 | 4100 | 4110 | 4040 | 4190 | 4270 | 4330 |

*Yarn speed

EXAMPLES 16–21 AND COMPARATIVE EXAMPLES 9–10

According to the formulations (%) shown in Table 4, treating compositions of this invention and those for comparison were prepared.

In the same manner as Examples 1–5, each composition was applied onto a nylon tire cord yarn the friction was measured. The results were as shown in Table 4.

TABLE 4

| | Example No. | | | | | | | | |
|---|---|---|---|---|---|---|---|---|---|
| | Example | | | | | | | Comparative Example | |
| | 16 | 17 | 18 | 19 | 20 | 21 | 22 | 9 | 10 |
| Dioleyl adipate | 59 | 57 | 57 | 59 | 57 | 50 | 50 | 55 | 60 |
| Surfactant-1 | 30 | 30 | 30 | 30 | 30 | 30 | 30 | 30 | 30 |
| Surfactant-2 | 10 | 10 | 10 | 10 | 10 | 10 | 10 | 10 | 10 |
| Surfactant-3 | — | — | — | — | — | — | — | 5 | — |
| Al compound-1 | 1 | 3 | — | — | — | — | — | — | — |
| Al compound-2 | — | — | 3 | — | — | — | — | — | — |
| Al compound-3 | — | — | — | 1 | 3 | 10 | — | — | — |
| Al compound-4 | — | — | 3 | — | — | — | 10 | — | — |
| Resistance to yarn breaking | 22 | 20 | 23 | 22 | 20 | 19 | 20 | 14 | 13 |

EXAMPLES 22–26 AND COMPARATIVE EXAMPLES 11–12

According to the formulations (%) shown in Table 5, treating compositions of this invention and those for comparison were prepared.

In the same manner as Examples 1–5, each composition was applied onto a nylon tire cord yarn the friction was measured. The results were as shown in Table 5.

TABLE 5

| | Example No. | | | | | | |
|---|---|---|---|---|---|---|---|
| | Example | | | | | Comparative Example | |
| | 22 | 23 | 24 | 25 | 26 | 11 | 12 |
| Dioleyl adipate | 59 | 57 | 55 | 57 | 57 | 57 | 57 |
| Surfactant-1 | 30 | 30 | 30 | 30 | 30 | 30 | 30 |
| Surfactant-2 | 10 | 10 | 10 | 10 | 10 | 10 | 10 |
| Mercaptosilane-1 | 1 | 3 | 5 | — | — | — | — |
| Mercaptosilane-2 | — | — | — | 3 | — | — | — |
| Mercaptosilane-3 | — | — | — | — | 3 | — | — |
| Silicone-1 | — | — | — | — | — | 3 | — |
| Silicone-2 | — | — | — | — | — | — | 3 |
| Resistance to yarn breaking | 28 | 26 | 24 | 26 | 23 | 13 | 15 |

EXAMPLES 27–32 AND COMPARATIVE EXAMPLE 13

According to the formulations (%) shown in Table 6, treating compositions of this invention and those for comparison were prepared.

In the same manner as Examples 6–10, each composition was applied onto a polyester tire cord yarn the friction was measured. The results were as shown in

TABLE 6

| | Example No. | | | | | | |
|---|---|---|---|---|---|---|---|
| | Example | | | | | | Comparative Example |
| | 27 | 28 | 29 | 30 | 31 | 32 | 13 |
| Dioleyl adipate | 55 | 50 | 50 | 50 | 50 | 55 | 60 |
| Surfactant-1 | 30 | 30 | 30 | 30 | 30 | 28 | 30 |
| Surfactant-2 | 10 | 10 | 10 | 10 | 10 | 10 | 10 |
| Surfactant-3 | — | — | — | — | — | — | — |
| Dioctyltindilaurate | 5 | 10 | — | — | — | 5 | — |
| Dibutyltindilaurate | — | — | 10 | — | — | — | — |
| Dioctyltindioleate | — | — | — | 10 | — | — | — |
| $(C_8H_{17})_2Sn(SCH_2COOC_{12}H_{25})_2$ | — | — | — | — | 10 | — | — |
| Friction ($T_2$, g) | | | | | | | |
| 0.5 m/min.* | 3250 | 3120 | 3130 | 3080 | 3140 | 3180 | 3450 |
| 300 m/min.* | 4150 | 4080 | 4090 | 4020 | 4090 | 4160 | 4250 |

*Yarn speed

Treating compositions of the present invention are capable of providing high resistance to breaking of yarn and low yarn-metal friction even under high load; and accordingly can improve operating efficiency, preventing yarn breaking, without breaking oil membrane of the composition adhered to the textile, even at severe treating conditions, for instance, in high-speed spinning, friction between yarn and various guids in stretching, friction between yarn and baloon control rings in high-speed fine spinning, and friction between yarn with heated rollers under high pressure contact in tire cord yarn.

Treating compositions of this invention are particularly useful for preventing lowering of operating efficiency caused by severer conditions of friction between yarn and heated rollers under high pressure contact at high draw ratio, which has recently been employed during production process of polyamide and polyester tire cords in order to increase tenacity of fiber.

In addition, treating compositions of this invention containing phosphorodithioate metal salts or dithiocarbamate salts, having anti-oxidant action, have improved thermal stability. Particularly, they can inhibit reduction in strength of adhesive-treated cords or fabrics of tire cord composed of synthetic fibers, such as polyester, polyamide and alamide fibers, and reduction in strength of tire cord with fatigue in rubber.

What is claimed as new and desired to be secured by Letters Patent is:

1. A textile treating composition, which consists essentially of (A) 0.2%–70%, based on the weight of the composition, of at least one organic compound to improve resistance to yarn breaking: which is a tin-containing carboxylate salt or carboxylate ester, and (B) at least one component selected from the group consisting of a lubricant, a surfactant and an antistatic agent, the amount of the lubricant being 10–90%, the amount of the surfactant being 10–70% and the amount of the antistatic agent being 0–20%, based on the weight of the composition; wherein said composition can contain as additional components only 0–10% of pH adjustor and 0–10% of one of more additives, based on the weight of the composition.

2. The composition of claim 1, wherein said organic compound is a tin-containing carboxylate salt or carboxylate ester represented by the formula (6a), (6b) or (6c):

$$(X_6)_a Sn \quad (6a)$$

$$(Y_6)_{4-b} Sn(OOCR_6)_b \quad (6b)$$

$$(X_6)_c Sn—Q_6—Sn(X_6)_c \quad (6c)$$

wherein a and b are integers of 1–4, c is an integer of 1–3; $X_6$ is selected from the group consisting of H, a substituted or unsubstituted hydrocarbon group, hydroxyl group, amino group, alkylamino group, arylamine group, alkoxy group, alkylthio group, arylthio group, mercapto group, acyl group, acyloxy group and halogen atom, at least a part of $X_6$ having ester group; $Y_6$ is selected from the group consisting of H, a substituted or unsubstituted hydrocarbon group, hydroxyl group, amino group, alkylamino group, arylamino group, alkoxy group, alkylthio group, arylthio group, mercaptio group, acyl group, acyloxy group and halogen atom; $R_6$ is H, a substituted or unsubstituted hydrocarbon group or $—(A_6)_d COOR'$; $A_6$ is an alkylene group; d is O or l; $Q_6$ is O, S or $—(A_6)_d COO—$; wherein each hydrocarbon group in $X_6$, $Y_6$ or $A_6$ contains 1–30 carbon atoms.

3. The composition of claim 1, which contains said compound (A) in an amount of at least 0.5% by weight.

4. The composition of claim 1, which comprises 0.5–70% of said compound (A), 10–88.5% of the lubricant, 10–70% of the surfactant and 1–20% of the antistatic agent, based on the weight of the composition.

5. The composition of claim 1, wherein the lubricant comprises at least one selected from the group consisting of a mineral oil, an animal oil, a vegetable oil, a fatty ester and a wax.

6. The composition of claim 1, wherein the surfactant comprises at least one selected from the group consisting of a nonionic surfactant and an anionic surfactant.

7. The composition of claim 1, wherein the surfactant comprises at least one selected from the group consisting of an oxyalkylated higher alcohol and oxyalkylated esters of polyhydric alcohol.

8. A method for treating a textile, which comprises applying the composition of claim 1 to a textile material at any stage during fiber-forming process and finishing process.

9. The method of claim 8, wherein the textile material is a natural, regenerated or synthetic fiber, which may be in the form of short fiber, long fiber, monofilament, multifilament, yarn or fabric.

10. The method of claim 8, wherein the textile material is a tire cord.

11. The method of claim 8, wherein the composition is applied to just after spinning or after drawing.

12. A textile product, comprising a textile material treated with the composition of claim 1.

13. The textile product of claim 12, containing said composition in an amount of 0.1–5%.

14. The textile product of claim 12, wherein the textile material is a tire cord.

15. The composition of claim 1, wherein said organic compound is a tin-containing carboxylate salt or carboxylate ester represented by the formula (7a), (7b) or (7c):

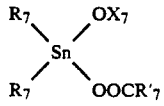
(7a)

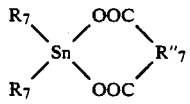
(7b)

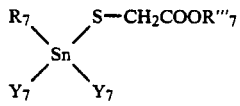
(7c)

wherein $R_7$ is an alkyl or aryl group containing 1–30 carbon atoms; $R'_7$ is a residue of monocarboxylic acid of the formula $R'_7COOH$ containing 1–30 carbon atoms; $R''_7$ is a residue of aliphatic or aromatic dicarboxylic acid of the formula $HOOC—R''_7—COOH$; $R'''_7$ is a residue of monohydric alcohol of the formula $R'''_7—OH$ selected from the group consisting of monohydric alcohol containing 1–40 carbon atoms and $C_2$–$C_4$ alkylene oxide adduct thereof; $X_7$ is H or $—OCR'_7$; and $Y_7$ is an alkyl group containing 1–30 carbon atoms or $—S—CH_2COOR'''_7$.

16. The method of claim 8, wherein the composition is applied at or before high-speed operation, whereby resistance to yarn breaking during the high-speed operation is improved.

17. The method of claim 16, wherein the high-speed operation is high-speed spinning, high-speed stretching or high-speed fine spinning.

* * * * *